US011195395B2

(12) United States Patent
Goulet

(10) Patent No.: US 11,195,395 B2
(45) Date of Patent: Dec. 7, 2021

(54) SYSTEM AND METHODS OF FIELD OF VIEW ALIGNMENT

(71) Applicant: Xtralis AG, Uznach (CH)

(72) Inventor: Thomas Goulet, Uznach (CH)

(73) Assignee: Xtralis AG, Uznach (CH)

( * ) Notice: Subject to any disclaimer, the term of this patent is extended or adjusted under 35 U.S.C. 154(b) by 0 days.

(21) Appl. No.: 15/534,846

(22) PCT Filed: Dec. 11, 2015

(86) PCT No.: PCT/EP2015/079391
§ 371 (c)(1),
(2) Date: Jun. 9, 2017

(87) PCT Pub. No.: WO2016/092066
PCT Pub. Date: Jun. 16, 2016

(65) Prior Publication Data

US 2017/0365144 A1 Dec. 21, 2017

(30) Foreign Application Priority Data

Dec. 11, 2014 (AU) ..... 2014905028

(51) Int. Cl.
*G08B 13/196* (2006.01)

(52) U.S. Cl.
CPC ... *G08B 13/19695* (2013.01); *G08B 13/1963* (2013.01); *G08B 13/19632* (2013.01); *G08B 13/19652* (2013.01)

(58) Field of Classification Search
None
See application file for complete search history.

(56) References Cited

U.S. PATENT DOCUMENTS

2004/0179093 A1* 9/2004 Inan ..... G08B 13/1963 348/36
2007/0109407 A1* 5/2007 Thompson ..... G08B 13/19632 348/143

(Continued)

FOREIGN PATENT DOCUMENTS

TW M381812 U 6/2010
TW 201301897 A 1/2013

(Continued)

OTHER PUBLICATIONS

"International Application No. PCT/EP2015/079391, International Search Report and Written Opinion dated Mar. 2, 2016", (dated Mar. 2, 2016), 11 pgs.

(Continued)

*Primary Examiner* — Ricky Chin
(74) *Attorney, Agent, or Firm* — Brooks, Cameron & Huebsch, PLLC

(57) ABSTRACT

The invention relates to a security system comprising: a first monitoring subsystem, said first monitoring subsystem being arranged to detect events within a first field of view using a first detection mechanism; a second monitoring subsystem, said monitoring subsystem being arranged to detect events within a second field of view using a second detection mechanism; a mounting arrangement configured to carry the first and second monitoring subsystems and mount them to a substrate; wherein in use, an alignable component of the first monitoring subsystem is configured to be orientated with respect to the mounting arrangement so that the first field of view covers an area to be monitored; and wherein the orientation of the alignable component of the first monitoring subsystem determines the orientation of the second field of view of the second monitoring subsystem.

16 Claims, 9 Drawing Sheets

(56) References Cited

U.S. PATENT DOCUMENTS

| | | | | |
|---|---|---|---|---|
| 2007/0236570 | A1* | 10/2007 | Sun | G01S 3/7864 348/159 |
| 2010/0141767 | A1* | 6/2010 | Mohanty | G08B 13/19643 348/159 |
| 2011/0310219 | A1* | 12/2011 | Kim | H04N 5/247 348/36 |
| 2014/0002648 | A1* | 1/2014 | DiPoala | H05K 5/0256 348/143 |
| 2014/0300735 | A1* | 10/2014 | Reibel | H04N 7/18 348/143 |
| 2016/0112608 | A1* | 4/2016 | Elensi | H04N 5/2252 348/143 |

FOREIGN PATENT DOCUMENTS

| | | | |
|---|---|---|---|
| TW | 201322755 | A | 6/2013 |
| WO | WO-2014187652 | | 11/2014 |
| WO | WO-2016092066 | | 6/2016 |

OTHER PUBLICATIONS

Taiwan Application No. 104141766, Search Report dated Jan. 21, 2019, (dated Jan. 21, 2019), 1 pg.

* cited by examiner

SYSTEM AND METHODS OF FIELD OF VIEW ALIGNMENT

PRIORITY CLAIM TO RELATED APPLICATIONS

This application is a U.S. national stage application filed under 35 U.S.C. § 371 from International Application Serial No. PCT/EP2015/079391, which was filed 11 Dec. 2015, and published as WO2016/092066 on 16 Jun. 2016, and which claims priority to Australia Application No. 2014905028, filed 11 Dec. 2014, which applications and publication are incorporated by reference as if reproduced herein and made a part hereof in their entirety, and the benefit of priority of each of which is claimed herein.

FIELD OF THE INVENTION

The present invention relates to systems and methods for use in security monitoring. Most particularly it relates to systems and methods with improved field of view alignment between two monitoring subsystems such as a PIR detector and camera.

The illustrative embodiments will be described in connection with perimeter monitoring applications, using a PIR detector and a pan, tilt, zoom camera but embodiments of the present invention may be used in other scenarios.

BACKGROUND OF THE INVENTION

Electro-optical detectors which form part of a monitoring subsystem such, as PIR detectors, cameras or the like, are widely used in security systems. These detectors are often mounted to fixed substrates, such as poles or walls, and when commissioned the detectors monitor a region against intrusion.

The alignment or positioning of the field of view of the detector in space defines the region that is being monitored. Standard practice is for technicians to manually align, both in the vertical and horizontal planes, the detectors during a commissioning phase. During this manual alignment process, two technicians may have to work together, with one technician performing a walk test through the field of detection, while the other makes iterative manual adjustments to the alignment of the detector.

The operation and sensitivity of the security systems that include this type of detector are very much dependent on the accurate manual commissioning of the detectors. If commissioning of a unit is not sufficiently accurate in accordance with the desired field of view, the likelihood of false alarms increases which ultimately results in an unreliable security system.

In order to improve detection performance and reliability, monitoring systems that combine two monitoring subsystems, e.g. a PIR and video motion detection (VMD) systems have been employed. To reduce the occurrence of false alarms from either technology, it is common practise to perform a logical AND operation on the VMD and PIR outputs to produce an alarm only if both detection methods go into alarm. This is called a "double-knock" system.

However the alignment problem mentioned above becomes more complex and hence time consuming for installers in such systems, because in addition to individual alignment of the fields of view with the desired area to be monitored, the fields of view of both detection subsystems need to be aligned with each other. This task is made more complex by the fact that the fields of view of the different subsystems may be different shapes, for example a PIR detector may have a field of view that is narrow in one direction, but highly elongate in another, whereas a camera will typically have a more conventional rectangular field of view with an aspect ratio of less than 1:2.

Despite this disadvantage, the most preferable situation would be to have matching fields of view for the two subsystems as this would to increase the validity of the double knock configuration.

Accordingly there is a need to improve the mechanism for alignment systems having multiple monitoring subsystems, each with its own field of view.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

In a first aspect of the present invention, there is provided a system comprising: a first monitoring subsystem, said first monitoring subsystem being arranged to detect events within a first field of view using a first detection mechanism; a second monitoring subsystem, said monitoring subsystem being arranged to detect events within a second field of view using a second detection mechanism; a mounting arrangement configured to carry the first and second monitoring subsystems and mount them to a substrate; wherein in use, an alignable component of the first monitoring subsystem is configured to be orientated with respect to the mounting arrangement so that the first field of view covers an area to be monitored; and wherein the orientation of the alignable component of the first monitoring subsystem determines the orientation of the second field of view of the second monitoring subsystem.

The alignable component may be any component of a detector or monitoring subsystem that is used to define its field of view. For example, the alignable component may be a detector head including electro-optical detector circuitry e.g. a camera or PIR sensor having a field of view, or an optical component or system including a lens, mirror, prism or the like, wherein the position and/or orientation relative to the mounting support defines a field of view or field of illumination of the alignable component of the detector.

The orientation of the second field of view is preferably determined so that it overlaps the first field of view, to thereby enable common events to be detected by the first and second subsystems using their respective detection mechanisms.

The alignable component of the first monitoring subsystem is preferably rotatably mounted with respect to the mounting arrangement.

The orientation of the second field of view is preferably determined by physically orientating an alignable component of the second monitoring subsystem with respect to the mounting arrangement.

The alignable component of the second monitoring subsystem is preferably rotatably mounted with respect to the mounting arrangement.

An axis of rotation of the alignable component of the first monitoring subsystem is preferably parallel or co-axial with an axis of rotation of the alignable component of the second monitoring subsystem.

The alignable component of the second monitoring subsystem is preferably mechanically coupled to the alignable component of the first monitoring subsystem.

The orientation of the second field of view may be determined by assigning a reference orientation for a coordinate system used by the second monitoring subsystem.

The system can include a sensing system to determine the relative orientation of the alignable component of the first monitoring subsystem, and an alignable component of the second monitoring subsystem.

The relative orientation is preferably used to assign the reference orientation of the second monitoring subsystem. The sensing system to determine the relative orientation preferably includes at least one directional sensor (e.g. electronic compass or inclinometer) associated with at least one of the first or second monitoring subsystems to determine an orientation of the alignable component.

The mounting arrangement preferably includes a mounting bracket. The alignable component of the first monitoring subsystem may be mounted to the mounting bracket. The alignable component of the second monitoring subsystem is mounted to the mounting bracket.

The alignable components of the first and second monitoring systems are preferably mounted to opposite sides of the mounting bracket.

The first monitoring subsystem is preferably a PIR detector and the second monitoring subsystem is preferably a camera.

In a second aspect of the present invention, there is provided a method comprising: orientating, with respect to a mounting arrangement, an alignable component of a first monitoring subsystem, said first monitoring subsystem being arranged to detect events within a first field of view using a first detection mechanism; wherein the orientation of the alignable component of the first monitoring subsystem determines the orientation of the second field of view of a second monitoring subsystem carried by the mounting arrangement, said second monitoring subsystem being arranged to detect events within a second field of view using a second detection mechanism.

Orientating the alignable component of the first monitoring subsystem preferably includes rotating the alignable component with respect to the mounting arrangements.

The method can include physically orientating an alignable component of the second monitoring subsystem with respect to the mounting arrangement.

The orientation of the second field of view may be determined by: assigning a reference orientation for a coordinate system used by the second monitoring subsystem.

The method preferably includes sensing the relative orientation of the alignable component of the first monitoring subsystem and an alignable component of the second monitoring subsystem.

The method preferably includes assigning the reference orientation of the second monitoring subsystem on the basis of the relative orientation.

In a third aspect of the present invention, there is provided a method in a security system including a first monitoring subsystem, said first monitoring subsystem being arranged to detect events within a plurality of zones within a first field of view using a first detection mechanism; a second monitoring subsystem, said second monitoring subsystem being arranged to detect events within a second field of view using a second detection mechanism, the field of view of the second monitoring subsystem being re-orientatable and/or relatively resized with respect to the first field of view; the method comprising; detecting an event by the first monitoring subsystem in one of the plurality of zones within the first field of view; controlling either or both of the orientation or size of the second field of view to coincide with a subset of the zones within the first field of view, but not the whole first field of view to enable verification of the event using the second monitoring subsystem.

The step of controlling either or both of the orientation or size of the second field of view preferably includes re-orientating the second field of view about a single axis. The method preferably includes re-orientating and resizing the second field of view to substantially coincides with the zone, or all zones, within the first field of view in which the event was detected.

The first and second monitoring subsystems preferably have corresponding alignable components which define their respective first and second fields of view, and said first and second sensor systems are mounted to a common mounting arrangement.

The security system is preferably a system of the type described by the first aspect or otherwise described herein.

The first and second monitoring subsystems may have corresponding alignable components which define their respective first and second fields of view, and said alignable components are mounted to different mounting arrangements.

The first monitoring subsystem is preferably a PIR detector and the second monitoring subsystem is preferably a camera.

BRIEF DESCRIPTION OF THE DRAWINGS

Embodiments of the present invention will now be described by way of non-limiting example only with reference to the accompanying drawings. In the drawings.

DETAILED DESCRIPTION OF THE EMBODIMENTS

In one form there is provided a system, e.g. a perimeter surveillance system, having a first monitoring subsystem, such as a PIR detection system, and a second monitoring subsystem being a video motion detection (VMD) system including a camera.

The PIR detection system has a PIR sensor that is arranged to detect events within a first field of view, and the camera of the VMD system is arranged to detect events within a second field of view. The PIR detector and camera are mounted to a substrate (e.g. a pole, wall, ground, other structure) via a mounting arrangement. Preferably the PIR detector and camera share a mounting bracket, but this is not essential so long as they are in a known physical relationship to each other.

In use, e.g. during commissioning or maintenance, the alignable components thereof, that dictate the orientation of their respective fields of view, will need to be aligned to monitor a desired area.

However, use of a mounting arrangement which carries theses parts of the monitoring subsystems in a fixed orientation with respect to the substrate on which it is mounted is not suitable, because in use the position or orientation of the substrate is may not enable the correct or accurate orientation of the fields of view. Therefore, the alignable component of one of the subsystems is carried by the mounting arrangement in a manner that enables its orientation with respect to the substrate to be changed.

Advantageously, the orientation of the alignable component of the first subsystem determines the orientation of the field of view of the other subsystem—e.g. the orientation of the PIR detector determines the orientation of the camera or vice versa.

This can be achieved in a range of ways, for example:

The alignable components of the two subsystems may be mechanically linked, so movement of one causes movement of the other;

The orientation of the alignable components of the first subsystem (either in an absolute sense (e.g. using a compass), or relative to the substrate; mounting arrangement; or part of the second monitoring subsystem, can be measured and communicated to the second monitoring subsystem to cause re-orientation of its field of view (e.g. using a drive to re-orientate its alignable component) or to set an orientation parameter, such as a reference position used by the second monitoring subsystem.

Figure 1:
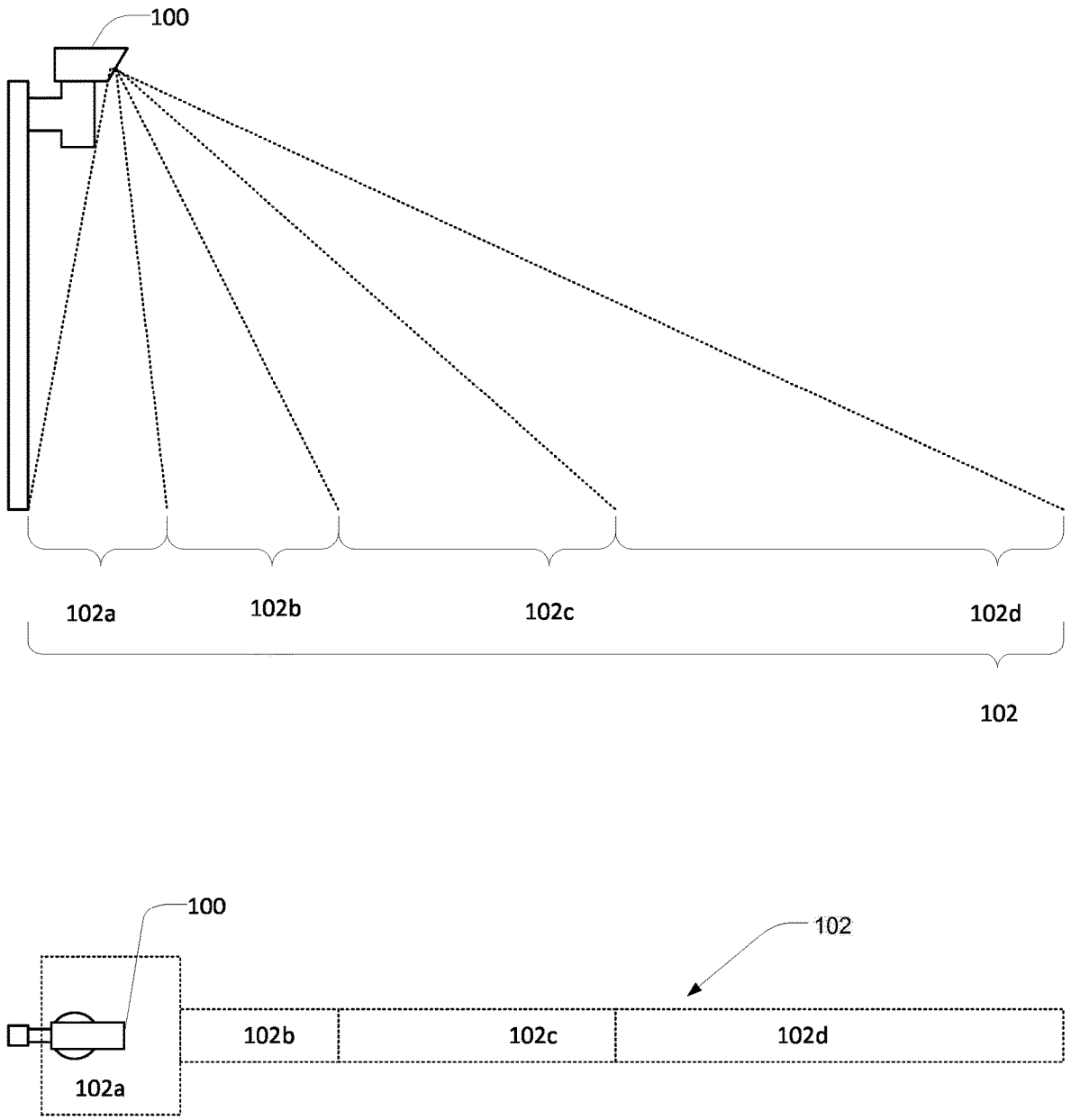
FIG. 1 is a schematic block diagram of a monitoring subsystem, in the form of a PIR detector mounted via a mounting arrangement to a substrate in the form of a pole, and illustrates the field of view of the PIR detector in side view (top) and plan view (bottom).

FIG. 1 is a block diagram illustrating a first monitoring subsystem, in the form of a passive infra-red (PIR) detector 100. The PIR detector 100 has a field of view 102 over which it can monitor for a thermal event as is known to those skilled in the art. The PIR detector 100 in this example, has four monitoring zones within its field of view 102. The four monitoring zones, from closest to furthest away are a creep zone (CZ) 102*a* which is directly beneath the mounted PIR detector 100; a short range zone 102*b*; a medium range zone 102*c*; and a long range zone 102*d*. The PIR detector 100 is configured to report a thermal change in any one of these zones as will be known to those skilled in the art.

As can be seen from the plan view illustration at the bottom of FIG. 1, the field of view 102 is relatively narrow in one direction and elongate in a transverse direction. Such a field of view makes a PIR sensor of this type particularly useful for perimeter monitoring, such as would be performed along a fence line or the like. The PIR detector 100 can for example be an ADPRO PRO E PIR detector made by Xtralis.

Figure 2:
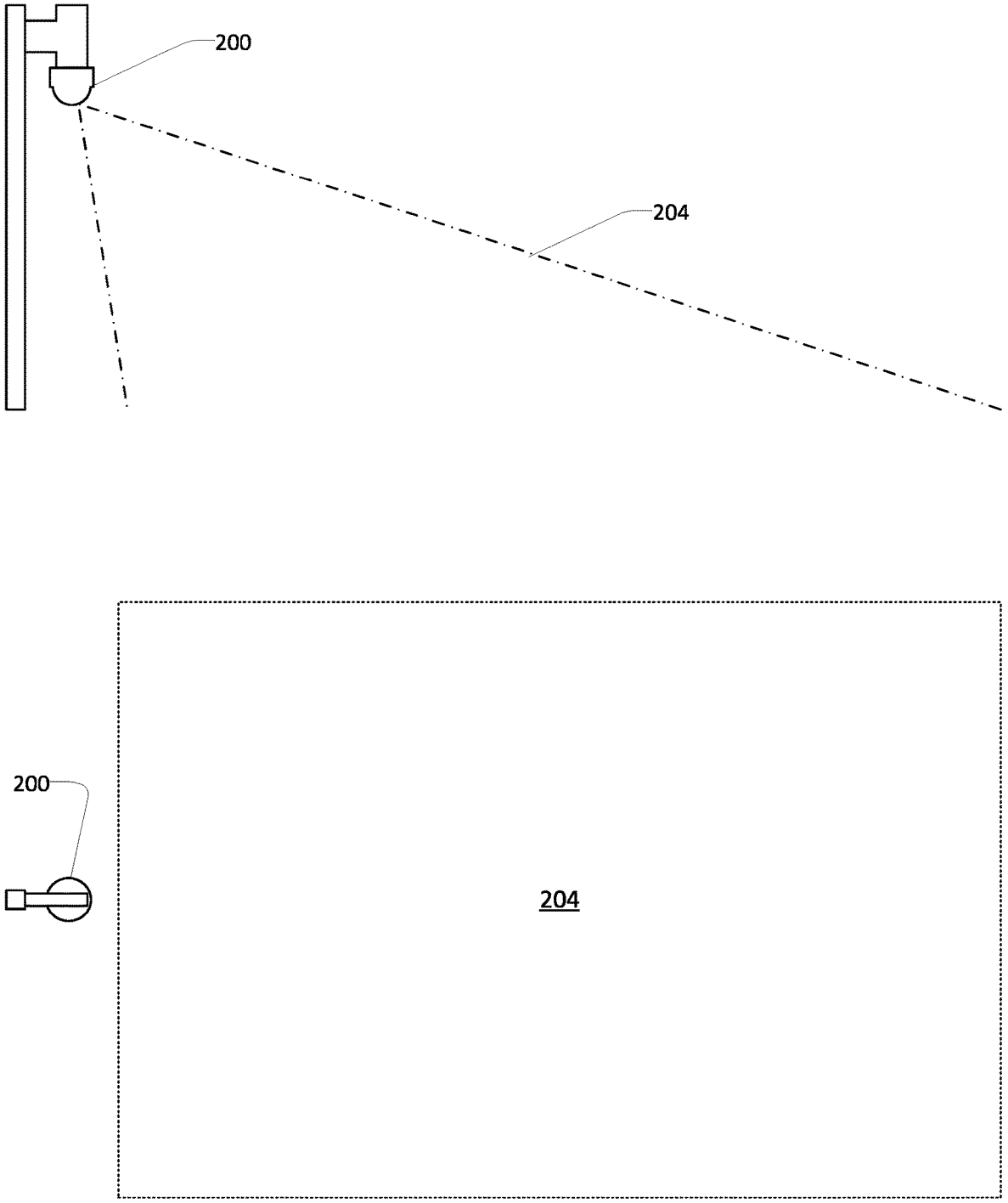
FIG. 2 is a schematic block diagram of monitoring subsystem, in the form of a camera mounted via a mounting arrangement to a pole, and illustrates the field of view of the camera detector in side view (top) and plan view (bottom).

FIG. 2 illustrates a second monitoring subsystem in the form of a video monitoring system 200. The video monitoring system includes a camera 200 mounted within a housing 202. The camera 200 can be either a fixed camera or, more preferably a camera which is able to be re-directed such as a pan and tilt camera. In particularly preferred embodiments the camera also has a zoom function. The camera 200 also has its own field of view 204. As can be seen in the plan view at the bottom view of the bottom of FIG. 2 the field of view of the camera 200 is generally rectangular and typically much larger than that of the PIR detector 100 of FIG. 2. In a preferred form the camera is an IP camera powered by power over Ethernet.

In use, the first monitoring subsystem and second monitoring subsystem can be used together e.g. in a double knock arrangement to monitor a common area. In order to this, the fields of view 102 and 204 of the first and second monitoring subsystems need to overlap such that an event detected in the first field of view 102 of the first monitoring subsystem 100 can also be detected in the second field of view 204 of the second monitoring subsystem 200.

General mechanisms for performing double knock and other cooperative alarming will not be described here in detail as these will be known to those skilled in the art.

As a preliminary step in the use of such a system, the system must be commissioned. That is, it must be installed and aligned such that the fields of view of the two monitoring subsystems coincide with the protected area which is being monitored. As mentioned above, physical limitations of the substrate to which the monitoring subsystems will be mounted may lead to a need for onsite alignment of the orientable components of the monitoring subsystem such that they align their field of view in an appropriate way with the area to be protected. Such an arrangement is shown in plan view in FIG. 3.

Figure 3:
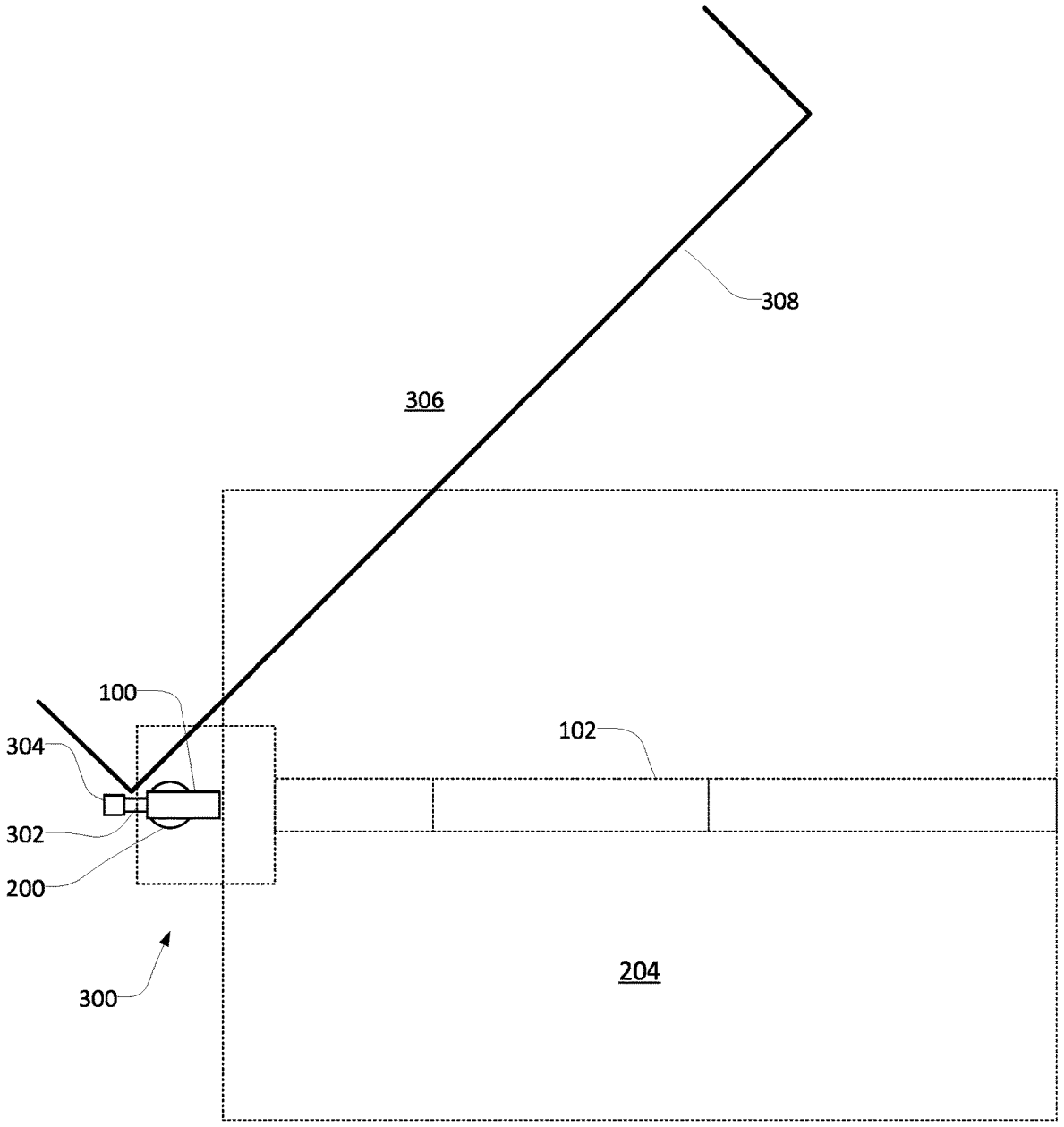
FIG. 3 is a plan view of the monitoring subsystems of FIGS. 1 and 2 mounted together on a common mounting arrangement in a location next to a protected area to be monitored—in this figure the PIR detector is designated as the first monitoring subsystem and the camera is the second monitoring subsystem.

FIG. 3 shows a first monitoring subsystem 100 and a second monitoring subsystem 200 supported on a mounting arrangement 302. The mounting arrangement 302 is attached to a substrate, which in this example is a post 304. The mechanism for attachment between the mounting arrangement 302 and the substrate 304 is unimportant but typically will be screwed or bolted to the substrate or attached with straps or the like. In this example, it will be seen that upon attachment of the monitoring subsystems 100 and 200 to the substrate 302, their fields of view 102 and 204 respectively extend off at an angle to the protected area 306. In this example, the protected area 306 is bounded by a perimeter fence 308 which is to be monitored by the monitoring system 300. In order to do this an alignable component of the monitoring subsystems need to be reorientated relative to the substrate 304 in order to be correctly aligned with respect to the desired area to be monitored, which in this case essentially comprises the long length of the perimeter 308 of the protected area 306.

Figure 4:
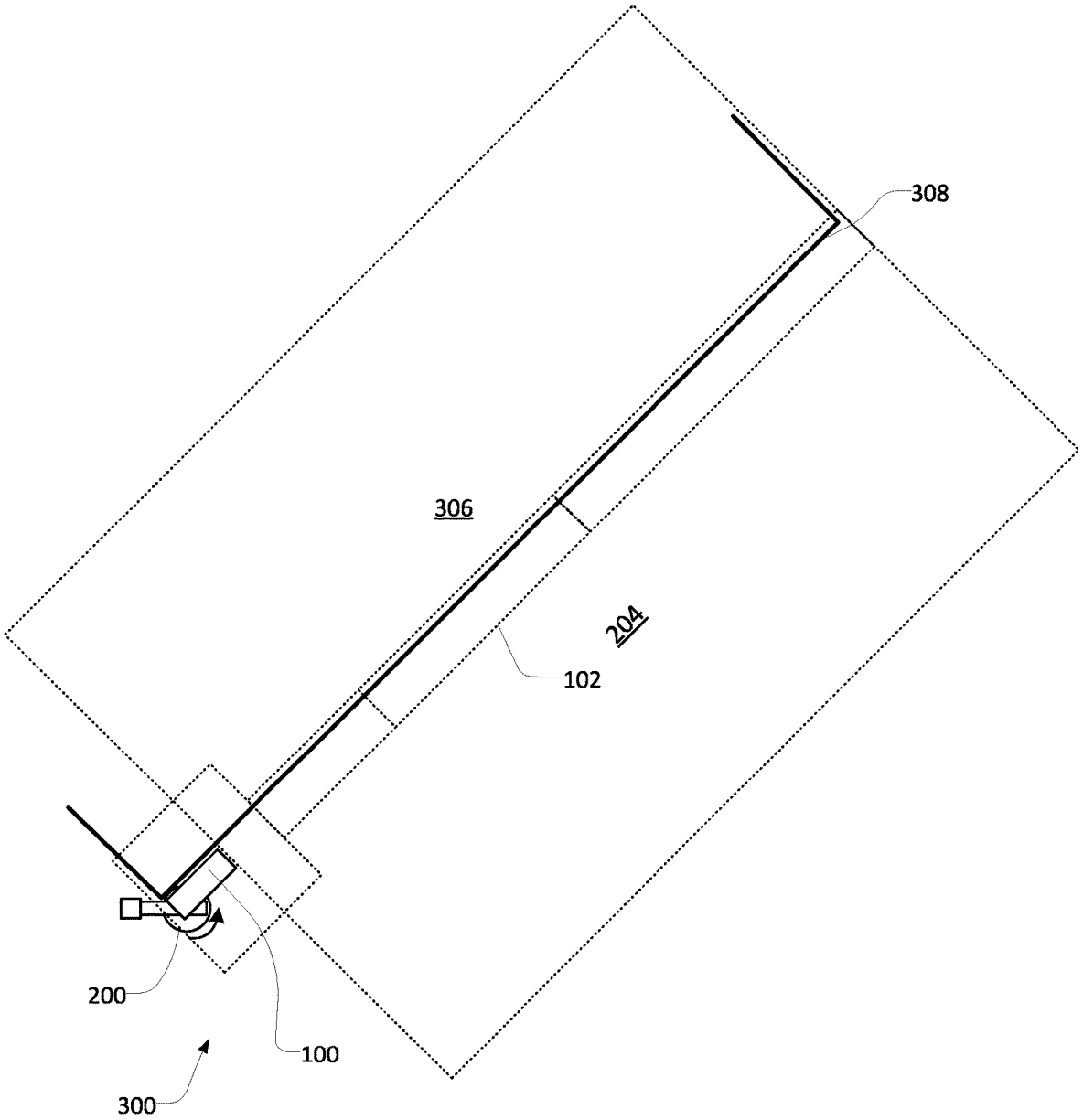
FIG. 4 is the system of FIG. 3 which has been configured such that the field of view of the PIR detector monitors the perimeter of the protected area.

FIG. 4 illustrates the system 300 in a state in which the alignable component of the first monitoring subsystem 100 has been rotated such that its field of view 102 lies along the perimeter 308 of the area to be protected 306 such that the perimeter can be monitored. In accordance with an embodiment of the present invention the process of orientating the alignable component of the subsystem 100 determines the alignment of the field of view 204 of the second monitoring subsystem 200. As will be described below, this mechanism can be performed in a variety of ways including, by providing a mechanical linkage between the alignable component of the first monitoring subsystem 200 and an alignable component of the second monitoring subsystem 200 or through passing data between them, for example over ethernet or other data communications channel.

Figure 5:
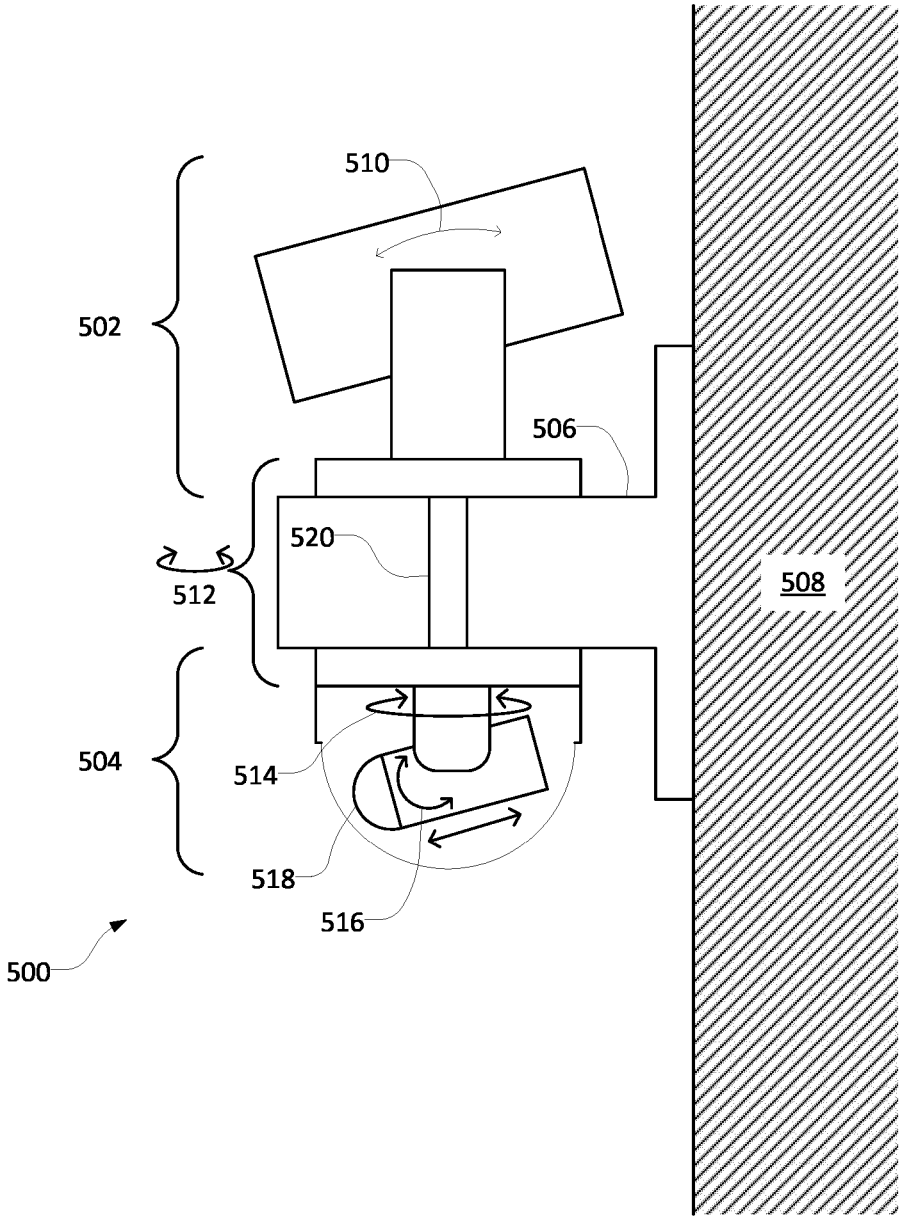
FIG. 5 illustrates an exemplary arrangement used to mechanically couple an alignable component of the PIR detector of FIG. 1 to an alignable component of a camera of FIG. 2.

Turning firstly to an example of a mechanical coupling between the two alignable components, an example of which is shown in FIG. 5. FIG. 5 illustrates a series of components 500 which form part of a monitoring system such as the monitoring system 300 of FIGS. 4 and 5. The components illustrated include an alignable component 502 of a first monitoring subsystem, which in this example is a PIR detector, and an alignable component of a second monitoring subsystem 504 which in this case is a video camera forming part of a video motion detection system. These alignable components 502 and 504 are carried by a mounting arrangement 506 which is affixed to a substrate 508 in a fixed relationship.

The alignable component 502 is alignable about two axes of rotation with respect to the mounting arrangement 506 and hence the substrate 508. The first axis of rotation 510 is a tilt axis enabling re-positioning of the field of view to extend or shorten the range of detection. The alignable component 502 is also pivotable about a vertical axis 512 to allow panning motion of it with respect to the mount 506. During commissioning, these two degrees of freedom will be adjusted by a technician such that the field of view of the first monitoring subsystem coincides with the area to be protected. Once correct alignment has been achieved the position of the alignable component 502 will be locked with respect to the mounting arrangement 506 (e.g. using a grub screw—not shown) such that correct alignment is maintained. As will be appreciated, from time to time realignment may be necessary as the mounting arrangement or substrate more with respect to each other or their surrounds.

The second alignable component 504 which forms part of the second monitoring subsystem is also alignable with respect to the mounting arrangement 506. However, in this example two forms of alignment are possible. A first primary alignment, used during commissioning, is a rotational alignment (e.g. about an axis 512) which is generally parallel or coaxial with the pan axis of the first alignable component 502. Rotation of the second alignable component 504 about the axis 512 is used to establish or set "home position" which is a datum point for the operation of the second monitoring subsystem. The second form alignment which is able to be performed by the alignable component 504 in this example is tilting and panning of its sensor (camera) about horizontal and vertical axis respectively. This motion occurs within the alignable component and is indicated by arrows 514 and 516 respectively. In this example the second monitoring subsystem is a pan, tilt, zoom camera, accordingly the camera 518 has a zoom functionality to enable the focal length of the camera 518 to be adjusted. In use, the pan tilt zoom functionality of the second monitoring subsystem is used to allow relatively rapid movement of the field of view of the second monitoring subsystem, whereas the first type of alignment mentioned above is used to set a defined orientation of the alignable component in commissioning.

In this example, a mechanical linkage 520, that extends through a void or aperture in the mounting arrangement (not shown), is provided between the first alignable component 502 and the second alignable component 504 such that a realignment of the first alignable component 502 determines the alignment of the alignable component 504, in this example the determination takes the form of physically realigning the alignable component 504 about the axis 512.

By providing this linkage it is possible for an installer to align the first alignable component, which forms part of the first monitoring subsystem and this causes the corresponding alignment in the alignable component of the second monitoring subsystem. Once this alignment is locked in place, movement of the field of view of the second monitoring subsystem can still take place via operation of its pan tilt zoom mechanism but its home position and primary alignment direction is fixed.

Figure 6:
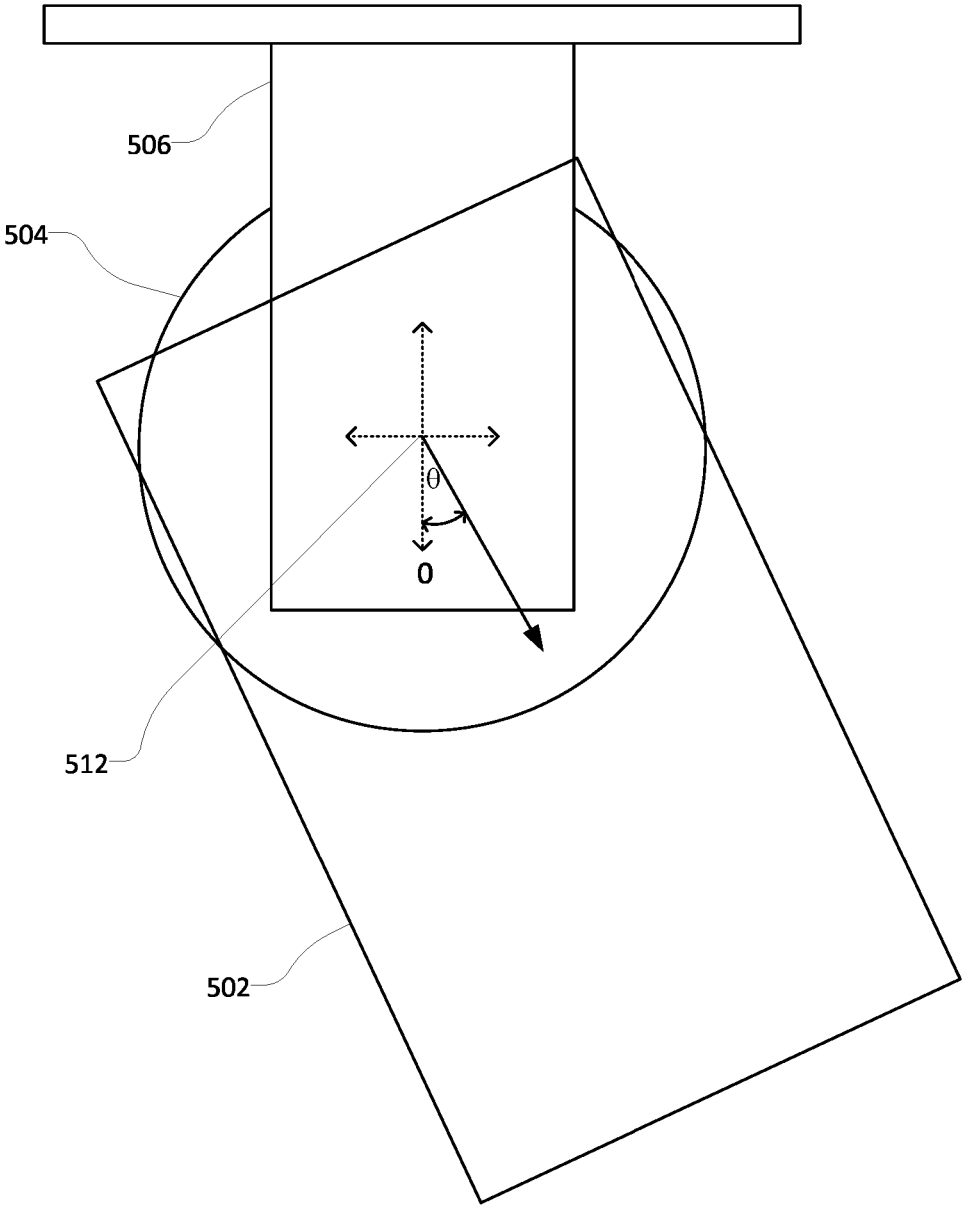
FIGS. 6 and 7 illustrate a principle by which the orientation of the alignable component of the first subsystem can determine the orientation of the field of view of the second monitoring subsystem without a mechanical coupling.
Figure 7:
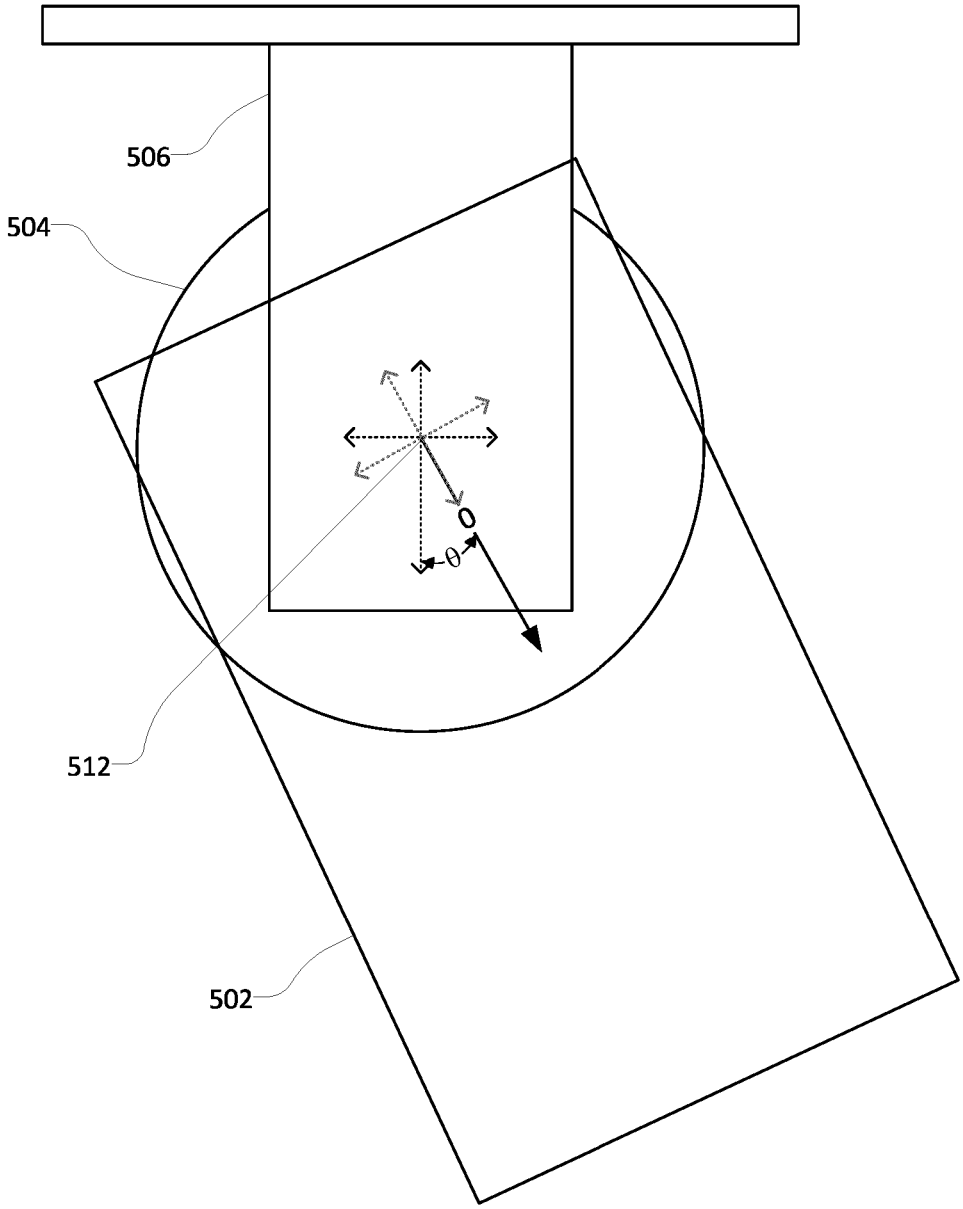

As will be appreciated from this embodiment, because the second monitoring subsystem includes a pan tilt zoom camera physical reorientation of the second alignable component 504 about the pan axis may not be necessary, but instead a notational determination of alignment can be performed by resetting a home position of the pan tilt zoom axis. FIG. 6 illustrates a top view of the arrangement 500 indicating the position of the first alignable component 502 and the second alignable component 504 with respect to the mounting arrangement 506. In this example, the alignment of the alignable component 502 about the axis 512 is offset by an angle θ, from an original (e.g. default factory setting) zero direction. As will be appreciated, because the alignable component 504 has a pan axis 514 which is generally aligned with the axis 512 there is no need to realign the entire component 504 about axis 512. Instead, the home position zero can be redefined to an orientation offset from its previous position by the angle θ and future panning operations of the pan tilt zoom mechanism can be performed with reference to this new zero point.

In order to perform this scheme, it is necessary to determine the orientation of the alignable components at least in a relative sense. In a preferred form, orientation about a pan axis can be performed by providing the first alignable component 502 with an electronic compass to determine its orientation. This orientation can then be used to set the zero point of the pan mechanism of the pan tilt zoom camera of the second monitoring subsystem.

As will be appreciated, a combination of the two mechanisms can be performed. For example, in some embodiments the position of the alignable component of the first monitoring subsystem can be determined using a sensor system such as an electronic compass and the output of the electronic compass can then be used to cause a physical realignment of the alignable component of the second monitoring subsystem. In order to do this automatically, the mounting arrangement or second alignable component can be fitted with a drive system such as an electric motor or other actuator which drives rotation of the second alignable component with respect to the mounting arrangement 506 until it is aligned correctly with respect to the alignable component of the first monitoring subsystem. It should also be noted that both alignable component can be fitted with orientation sensors such that their relative alignment can be determined, as opposed to using an absolute alignment with respect to magnetic or true north.

In addition to the advantages described in connection with commissioning and maintaining a system using embodiment of the present invention, certain embodiments have advantageous properties for use in detecting events as will now be described.

Figure 8:
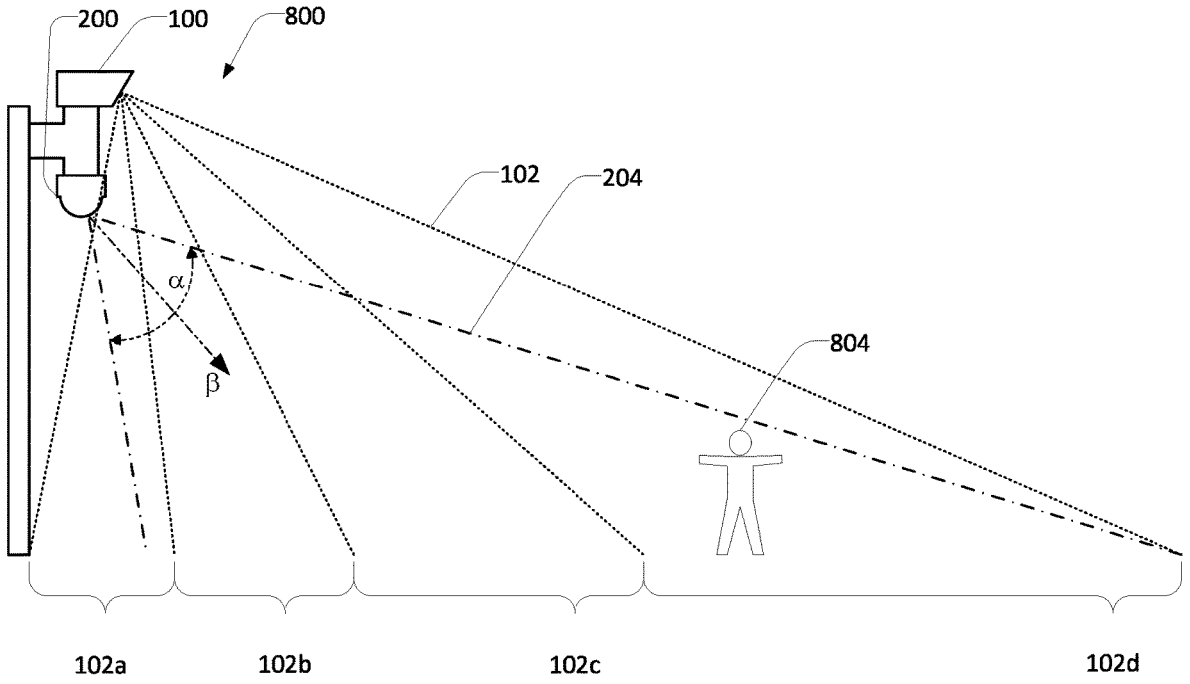
FIGS. 8 and 9 illustrate an exemplary mode of operation of the system of FIG. 3 when an intrusion is detected by the first monitoring subsystem.

FIG. 8 illustrates a security system 800 which includes a first monitoring subsystem 100 which is a PIR system as described in FIG. 1, and a second monitoring subsystem 200 in the form of a pan tilt zoom camera 200 as described in connection with FIG. 2. Their fields of view are aligned as per FIG. 4 such that an intruder into the field of view of both monitoring subsystems will trigger an alert. As can be seen from FIG. 8, the field of view of the PTZ camera 200 can be defined by its viewing angle α and the direction of vector β which lies in the centre of the field of view. In its ordinary detecting mode α is relatively wide such that the field of view of the camera 200 extends across the majority of the field of view 102 of the PIR detector. In this example, the PIR detector has three zones short range, medium range, and long range within the field of view 204 of the camera 200. If an intruder 804 is sensed by both the video motion detection algorithms running on the second monitoring subsystem, and by the PIR detector of the first monitoring subsystem an alert will be generated. However, the present system also enables the rapid realignment of the field of view 204 of the second monitoring subsystem 200 to either provide more accurate confirmation of the detection event or provide more detailed information for transmission to a central monitoring station as will be described in connection with FIG. 9.

Figure 9:
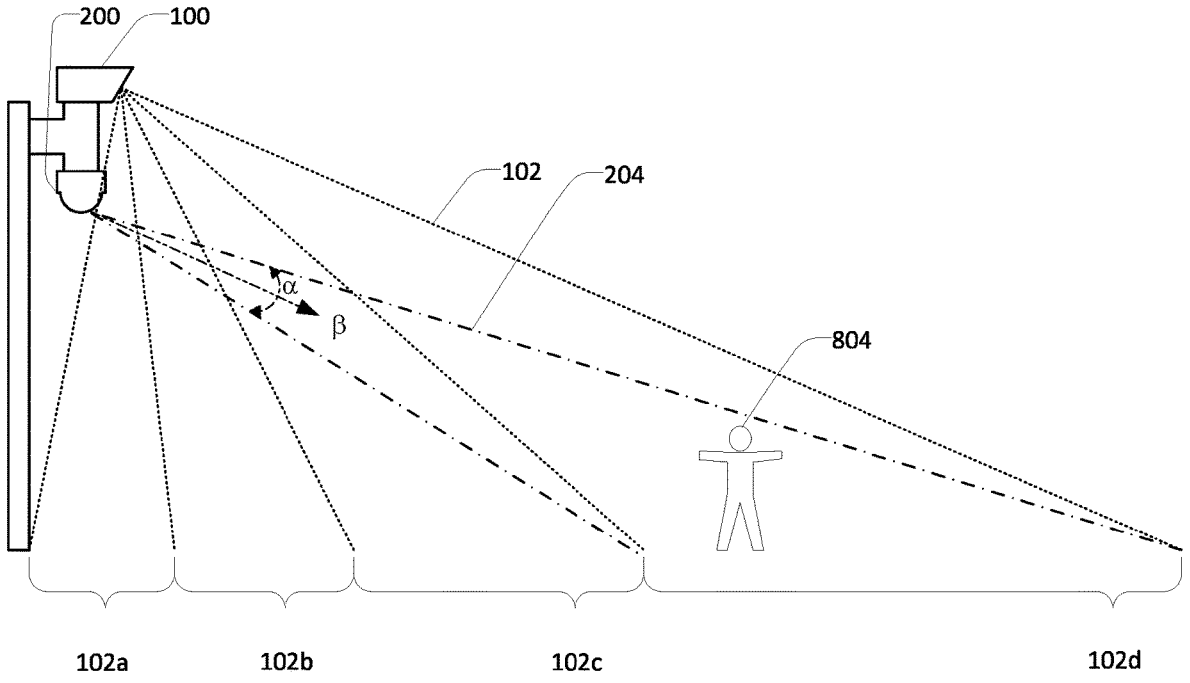

In FIG. 9, the field of view 204 of the second monitoring subsystem 200 has been modified by activating the zoom, and tilt functionality of the PTZ camera. In this regard, because the home position of the pan axis of the PTZ system 200 is fixed in line with the longitudinal axis of the PIR field of view 102, the field of view 204 of the PTZ camera 200 can be rapidly readjusted to focus on just the portion of the PIR field of view in which the event was detected, namely, the long range zone of the PIR field of view. This is achieved by activating the tilt drive of the PTZ camera. The focal length of the camera can also be zoomed-in such that the long range zone of the PIR sensor's field of view 102 is imaged in greater detail which increases reliability of the video analysis and aids human verification of the event. Once verification has been performed the field of view 204 of the second monitoring subsystem can be returned to normal as illustrated in FIG. 8.

Figure 10:
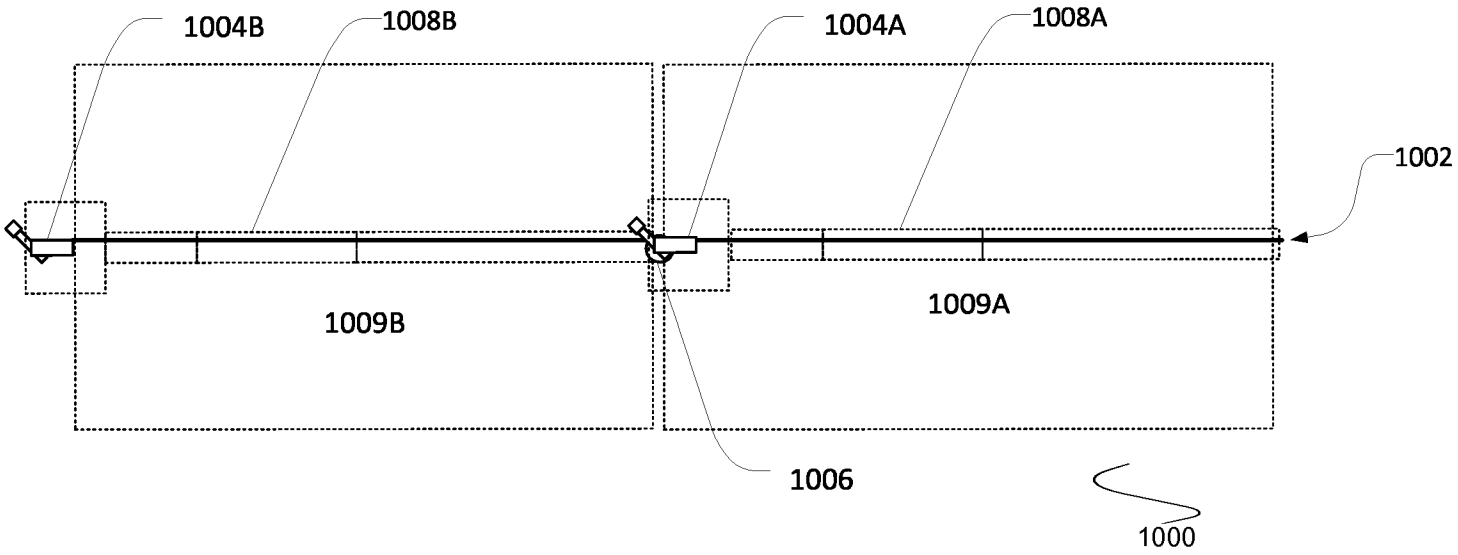
FIG. 10 is a schematic view of a system comprising a plurality of first monitoring subsystems which cooperate with a single second monitoring subsystem to monitor an extended perimeter having a length greater than the range of the field of view of either first monitoring subsystem.

FIG. 10 illustrates a further embodiment of an aspect of the present invention. This aspect takes advantage of the ease of alignment provided by embodiments of the present invention to extend the range of double knock detection to systems which otherwise would not be able to use this functionality, or at least to do so would be uneconomical due to the complex setup requirements. In this example, the system 1000 is used to monitor intrusion across a perimeter 1002 using two PIR detector 1004A and 1004B and a single camera 1006. The PIR detector 1004A and camera 1006 together form a system that operates in accordance with the previous embodiments of the invention in particular the embodiment illustrated in FIG. 8. In the event that the video motion detection system coupled to the camera 1006 detects an intruder in area FOV area 1 1009A and the PIR detector 1004A detects a thermal event in its field of view 1008 an about will be signalled. However, the PIR detector 1004B is not provided with an associated camera 1006 but instead is communicatively coupled to the camera 1006 associated with PIR detector 1004A via a data network. In the event that PIR detector 10048 detects a thermal event in its field of view 1008B camera 1006 is notified and its orientation is changed by panning, tilting and zooming to a known set point such that it views FOV area 2 1009B. In this condition, it can perform video motion detection over the entire field of view of the PIR detector 1004B to confirm the occurrence of the detection event sensed by the PIR detector 1004B. In this way, the same double knock detection scheme can be employed for the PIR detector 1004B even though it does not have a camera mounted with it. As with previous embodiment, once the initial video motion detection process has been performed, and if an event has been detected with the VMD analysis, the field of view of the camera 1006 can again be changed such that it coincides with a region or regions within the field of view of the PIR detector 1004B in which the thermal event was detected.

Once such a detection event has been resolved, the field of view of the PTZ camera 1006 is returned to its home position, which is aligned with the field of view of PIR detector 1004A.

By using the scheme as described above, double knock reliability can be performed over an extended area without providing each PIR detector with an associated camera.

Whilst the alignment of the field of view of the camera 1006 and PIR detector 1004B will be performed using a relatively conventional commissioning process. The overall commissioning burden of this two PIR system will not be greatly increased over a conventional single PIR camera system because of the alignment of the fields of view of the camera 1006 and the PIR detector 1004A is greatly simplified using the schemes described above.

As will be appreciated the system can be extended to cover any number of first and second monitoring subsystems and is not limited to the two PIR, one camera example given.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A field of view alignment system comprising:

a first monitoring subsystem, said first monitoring subsystem being arranged to detect events within a first field of view using a first detection mechanism, the first monitoring subsystem having a first alignable component being a detector head or a camera;

a second monitoring subsystem, said second monitoring subsystem being arranged to detect events within a second field of view using a second detection mechanism, the second monitoring subsystem having a second alignable component being a detector head or a camera;

wherein an axis of rotation of the first alignable component is parallel or co-axial with an axis of rotation of the second alignable component;

a mechanical linkage provided to create a fixed orientation between the first alignable component and the second alignable component with respect to their axis of rotation;

a mounting arrangement configured to carry the first and second monitoring subsystems and mount them to a substrate;

wherein in use, the first alignable component is configured to be orientated with respect to the mounting arrangement and configured to be locked in such orientation so that the first field of view covers an area to be monitored; and whereby the mechanical linkage and fixed orientation between the first and second alignable components is such that the orientation of the first alignable component directly physically orientates the second alignable component with respect to the substrate, which determines the orientation of the second field of view of the second monitoring subsystem.

2. The system of claim 1, wherein the detector head includes electro-optical detector circuitry.

3. The system of claim 1, wherein the first alignable component is rotatably mounted with respect to the mounting arrangement.

4. The system of claim 1, wherein the orientation of the second field of view is determined so that it overlaps the first field of view, to thereby enable common events to be detected by the first and second subsystems using their respective detection mechanisms.

5. The system of claim 1, wherein the system further includes a sensing system to determine the relative orientation of the first alignable component and the second alignable component.

6. The system of claim 5, wherein the sensing system includes at least one directional sensor associated with at least one of the first or second monitoring subsystems to determine an orientation of the first or second alignable component.

7. The system of claim 1, wherein the mounting arrangement includes a mounting bracket, and the first and/or second alignable component is mounted to the mounting bracket.

8. The system of claim 7, wherein the first and second alignable components are mounted to opposite sides of the mounting bracket.

9. The system of claim 1, wherein the first is a PIR detector and the second alignable component is a video motion camera.

10. A method of field of view alignment comprising:

providing a mounting arrangement configured to carry a first monitoring subsystem having first alignable component being a detector head or a camera, and a second monitoring subsystem having a second alignable component being a detector hear or a camera, the mounting arrangement mounting them to a substrate;

wherein an axis of rotation of the first alignable component is parallel or co-axial with an axis of rotation of the second alignable component;

orientating, with respect to the mounting arrangement, the first alignable component, and locking into such orientation, said first monitoring subsystem being arranged to detect events within a first field of view, using a first detection mechanism;

providing a mechanical linkage between the first alignable component and the second alignable component, to create a fixed orientation between the first alignable component and the second alignable component with respect to their axis of rotation, such that the orientation of the first alignable component with respect to the substrate directly physically orientates the second alignable component and determines the orientation of the second field of view of the second monitoring subsystem carried by the mounting arrangement, said second monitoring subsystem being arranged to detect events within the second field of view using a second detection mechanism.

11. The method of claim 10, wherein orientating the first alignable component includes rotating the first alignable component with respect to the mounting arrangement.

12. The method of claim 10, wherein the method further includes sensing the relative orientation of the first alignable component and the second alignable component.

13. The method of claim 12, wherein the method includes assigning the reference orientation of the second monitoring subsystem on the basis of the relative orientation.

14. A method of claim 10, wherein the method is implemented in a security system including:

a first monitoring subsystem, said first monitoring subsystem being arranged to detect events within a plurality of zones within a first field of view using a first detection mechanism;

a second monitoring subsystem, said second monitoring subsystem being arranged to detect events within a second field of view using a second detection mechanism, the field of view of the second monitoring subsystem being re-orientatable and/or relatively resized with respect to the first field of view;

the method comprising;

detecting an event by the first monitoring subsystem in one of the plurality of zones within the first field of view; and controlling either or both of the orientation or size of the second field of view to coincide with a subset of the zones within the first field of view, but not the whole first field of view, to enable verification of the event using the second monitoring subsystem.

15. The method of claim 14, wherein the step of controlling either or both of the orientation or size of the second field of view includes re-orientating the second field of view about a single axis.

16. The method of claim 14 further including re-orientating and resizing the second field of view to substantially coincides with the zone, or all zones, within the first field of view in which the event was detected.

* * * * *